US009295343B1

(12) United States Patent
Gratt

(10) Patent No.: US 9,295,343 B1
(45) Date of Patent: Mar. 29, 2016

(54) RESTRAINT AND SUPPORT FOR A CHILD IN A CHAIR DEVICE AND METHOD

(71) Applicant: Chavie Gratt, Monroe, NY (US)

(72) Inventor: Chavie Gratt, Monroe, NY (US)

( * ) Notice: Subject to any disclaimer, the term of this patent is extended or adjusted under 35 U.S.C. 154(b) by 0 days.

(21) Appl. No.: 14/701,992

(22) Filed: May 1, 2015

(51) Int. Cl.
*A47C 31/00* (2006.01)
*A47D 15/00* (2006.01)

(52) U.S. Cl.
CPC ..... *A47D 15/006* (2013.01)

(58) Field of Classification Search
CPC ... A47D 15/006; A47D 13/04; A47D 15/008; A47D 15/005; A47D 13/086; A62B 35/00; B60R 22/00
USPC ..... 297/465, 464, DIG. 6, 4; 2/102, 912, 2/913, 914, 915, 918, 919, 920; 24/306
See application file for complete search history.

(56) References Cited

U.S. PATENT DOCUMENTS 1,310,958 A * 7/1919 O'Connor ..... 297/484
2,170,703 A * 8/1939 Waxman et al. ..... 2/49.4
2,448,076 A 8/1948 Bradley
3,125,373 A * 3/1964 Boatman ..... A47D 15/006 297/465
3,125,375 A 3/1964 Bird et al.
D203,250 S * 12/1965 O'Link ..... D2/829
4,026,245 A 5/1977 Arthur
D256,850 S * 9/1980 Donahue ..... D2/829
4,429,419 A * 2/1984 Snyder ..... 2/102
4,639,946 A 2/1987 Koenig
5,730,498 A * 3/1998 Hanson ..... B60R 22/14 2/2.17
5,815,834 A 10/1998 Bronson
6,976,276 B2 * 12/2005 Corbitt, Jr. ..... 2/458
7,591,510 B1 * 9/2009 Giampavolo ..... 297/256.17
8,032,949 B1 * 10/2011 Matthews ..... A41D 1/04 2/102
2008/0252132 A1 * 10/2008 Thomson ..... A41D 13/00 297/465

FOREIGN PATENT DOCUMENTS

GB 2504294 A * 1/2014 ..... A47D 15/008

* cited by examiner

*Primary Examiner* — Milton Nelson, Jr.
(74) *Attorney, Agent, or Firm* — Michael J. Feigin, Esq.; Feigin & Fridman

(57) ABSTRACT

Restraining and supporting a child in a chair using a combination vest and chair attachment is disclosed herein. The vest can include two straps, each of which can have two loops. One loop can be located under the arm hole of the vest and may include a second portion of a connector. The other loop may be removably attached to a pole on the back of a chair and can also include a first portion of the connector. The loops containing the first portions of the connectors can be removably attached to separate poles on either side of a back of a chair. The connectors allow the vest to be removably attached to the chair. In one embodiment, the two loops removably attached to the chair are formed by using a buckle.

9 Claims, 7 Drawing Sheets

RESTRAINT AND SUPPORT FOR A CHILD IN A CHAIR DEVICE AND METHOD

FIELD OF THE DISCLOSED TECHNOLOGY

The disclosed technology relates generally to restraining and supporting a child in a chair, and, more specifically, to a combination vest and chair attachment.

SUMMARY OF THE DISCLOSED TECHNOLOGY

The method and device in the disclosed technology meet the needs existing in the prior art in a number of ways. First, the vest fits snuggly on the child and can include two straps which secure and support a child, special needs individual, or elderly person in a chair. Each strap may include two loops. One loop may be located under each arm hole and may include a second of two portions of a connector, which may be a clip. The other loop of the two loop set may be removably attached to a pole on the back of a chair and may also include the first of two portions of a connector. The loops attached to the first portions of the connectors can be removably attached to separate poles on either side of a back of a chair. Said connectors allow the vest to be easily attached to, or detached from, the loops removably connected to the chair. The two loops removably attached to the chair are readily installed and removed. In one embodiment, a buckle is used to create said loops, and each said loop encloses a separate pole on either side of the back of a chair. The vest is made of flexible material which is lightweight and foldable for easy transport. An advantage of the technology is that it can be easily transported and installed in restaurants or during visits to family or friends. In an embodiment of the technology, the vest connectors may be detached, allowing the child to be removed from the chair while still wearing the vest, leaving the two loops attached to the poles of the chair.

The disclosed technology further includes a method of securing a child in a chair comprising the steps of placing each arm of a child's arms through a respective portal of a vest, while simultaneously covering the torso of the child with the vest. The back of the vest is closed by attaching left and right flaps of the vest together with removable fasteners, wherein each left and right flap forms a contiguous structure with each other by way of said torso area of the vest. Right and left loops are attached to corresponding right and left poles of a chair, wherein the right and left poles are on either side of a back of a chair. The first of two portions of a removable connector is attached to each left and right loop, forming a unitary structure with same. The second portion of each removable connector is permanently attached to the corresponding side of the vest.

Further disclosed is a device for securing a child in a chair comprising a vest covering the front, back and sides of a child's torso. The vest includes an opening from a collar to a bottom of the vest, forming left and right flaps, and an arm portal at each side of the vest. A first set of fastening mechanisms having a fixed portion attached to each of the left and right flaps removably fastens the flaps to one another. A second set of fastening mechanisms is located between each arm portal and the bottom of the vest, and each such fastener has a fixed portion attached to the torso of the vest. A left and right strap, each with a removable fastening mechanism at a first end and a loop at a second end, wherein each said removable fastening mechanism of said left and right strap removably attaches to a corresponding right and left said second set of fastening mechanisms.

In another embodiment of the device, one end of the left and right straps is fixedly attached to, and extends from, the bottom corners of the sides of the vest.

In a further embodiment of the device, the second set of fastening mechanisms is permanently attached to a loop, which is, in turn, permanently attached to said vest.

In another embodiment of the device, the loops attached to the vest are located under each arm hole.

In a further embodiment, the opening on the device is located on the back of the vest.

In another embodiment of the device, the first set of fastening mechanisms further comprises straps, bearing a hook-and-loop-sealable means on one side, wherein a portion of each said strap, including one end, is fixedly attached to one flap, and two corresponding rings are fixedly attached to the other flap, so as to allow the unattached end of each strap to be inserted through its corresponding ring; the strap is then folded onto itself to close the fastener.

In a further embodiment of the device, the first set of fastening mechanisms further comprises two loops fixedly attached near the edge of one flap, wherein a ring is contained in the loop.

Also disclosed is a device for securing a child in a chair, comprising a vest with at least a portal for the head, a portal for each arm, and a portal for the torso, at least two straps being fixed to each of a left and right side of the vest, with a first part of a removable connector on each of the straps, a length of fabric with a loop and a second part of the removable connector, wherein said first part of the removable connector and the second part of the removable connector are adapted to removably attach to each other, or are removably attached to each other.

In a further embodiment, the device includes two lengths of fabric, wherein the first length of fabric attaches to the first of the at least two straps on the left side of the vest and a second length of fabric attaches to a second of the at least two straps on the right side of the vest.

In a further embodiment of the device, each loop is attached around a pole of a chair.

DETAILED DESCRIPTION OF EMBODIMENTS OF THE DISCLOSED TECHNOLOGY

The disclosed technology described herein sets forth a method and device for restraining and supporting an infant or child in a chair, and, more specifically, to a combination vest and chair attachment. Restraining and supporting a child in a chair, using a combination vest and chair attachment, is disclosed herein. The vest can include two straps, each of which can have two loops. One loop can be located under the arm hole of the vest and may include a second portion of a connector. The other loop may be removably attached to a pole on the back of a chair and can also include a first portion of the connector. The loops containing the first portions of the connectors can be removably attached to separate poles on either side of a back of a chair. The connectors allow the vest to be removably attached to the chair. In one embodiment, the two loops removably attached to the chair are formed using a buckle.

Embodiments of the disclosed technology will become clearer in view of the following discussion of the figures.

Figure 1:
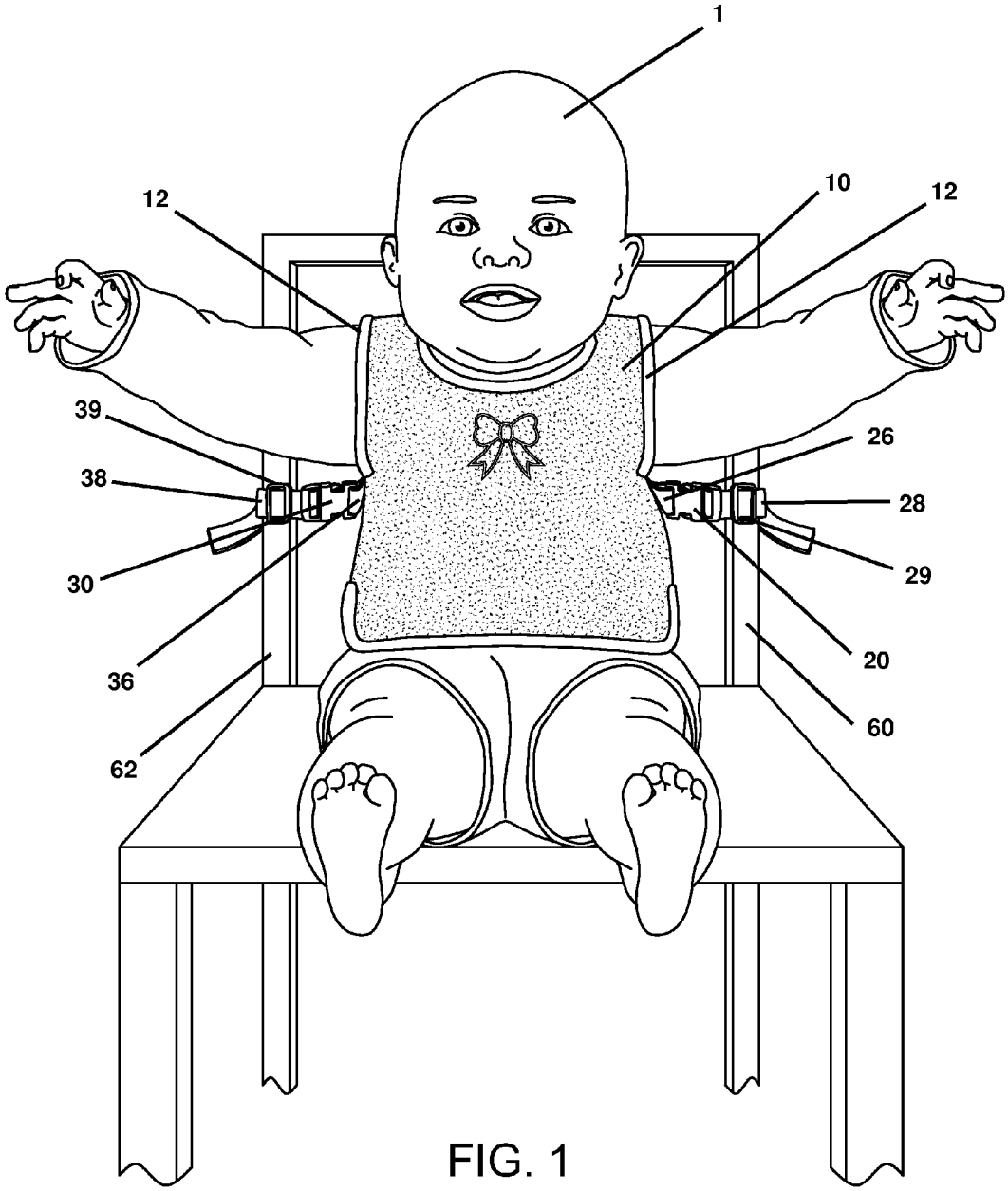
FIG. 1 shows a front elevation view of a child wearing the vest, while restrained in a chair with each of the two connectors attached to its corresponding pole on the back of the chair.

FIG. 1 shows a front elevation view of a child wearing the vest while restrained in a chair, with each of the two connectors attached to its corresponding pole on the back of the chair. The arms of a child 1 are inserted through respective arm portals 12 (such as sleeves or holes specifically tailored for arms) of a vest 10 simultaneously covering a torso of said child. Thereafter, a right 28 and left 38 loop are removably attached to respective right 60 and left 62 poles on either side of a back of a chair. In embodiments, for safety purposes, the poles on the back of the chair are at a lower portion of the back of the chair and are interrupted by a cross beam or horizontal pole, in order to prevent the loops from moving upwards or detaching from the pole. In an alternative embodiment, the loops are attached to or around a pole which forms part of a base of the chair.

The loops 28/38 are attached to the poles 60/62 of a chair, wherein the loops 28/38 are contained within the structure of the chair and cannot be slipped off or removed without opening the loop by freeing the strap from the buckle 29/39. Detachable connectors 20 are attached to loops 28/38 and to loops 26/36, which, in turn, are permanently attached to the vest 10. The term "vest," as used in this application, refers to a material which substantially covers a person's torso, contains an opening for donning and removing said vest, and bears straps with connectors for attachment to the poles of the back of a chair. For the purposes of this application, the terms "vest" and "bib" may be used interchangeably. Furthermore, the term "vest" may include a shirt, short or long-sleeved; sweater, or other garment which substantially covers the torso. "Torso," as defined in this application, means the central portion of the human body between the neck and waist, excluding the arms. The terms "torso" and "trunk" may be used interchangeably, for the purposes of this application. For purposes of this application, "pole" may refer to a bar, support, or member which a loop 28/38 may enclose, or an aperture in which a loop 28/38 may enclose a portion of the perimeter thereof. "Permanently," as used in this application, means "intended to remain fully intact and connected even beyond normal use of the device holding a person there-in and lacking disconnection means, such that to cause disconnection within such an item requires at least partial destruction thereof."

Figure 2:
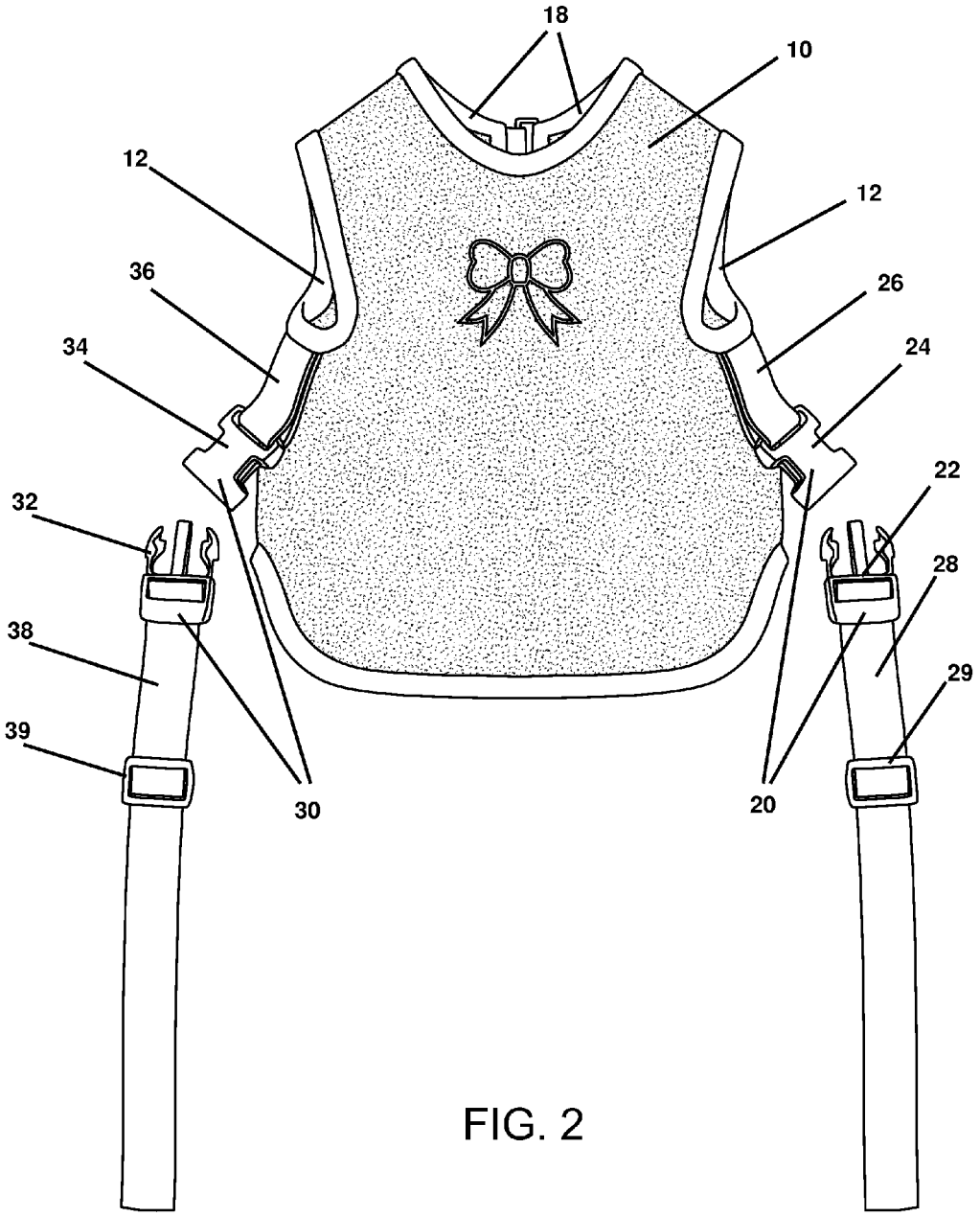
FIG. 2 shows a front elevation view of the vest with connectors in an unlatched position.

FIG. 2 shows a front elevation view of the vest 10, with right and left loops with buckles 29/39 used to form said loops 28/38, connectors 20/30, right and left first portions of the connectors 22/32, right and left second portions of the connectors 24/34, loops 26/36, to which said right and left second portions 24/34 of the connectors are attached, armholes 12 and neck hole 18. Right and left first portions 22/32 of the connectors 20 removably engage the corresponding right and left second portions 24/34 of the connectors 20/30.

Figure 3:
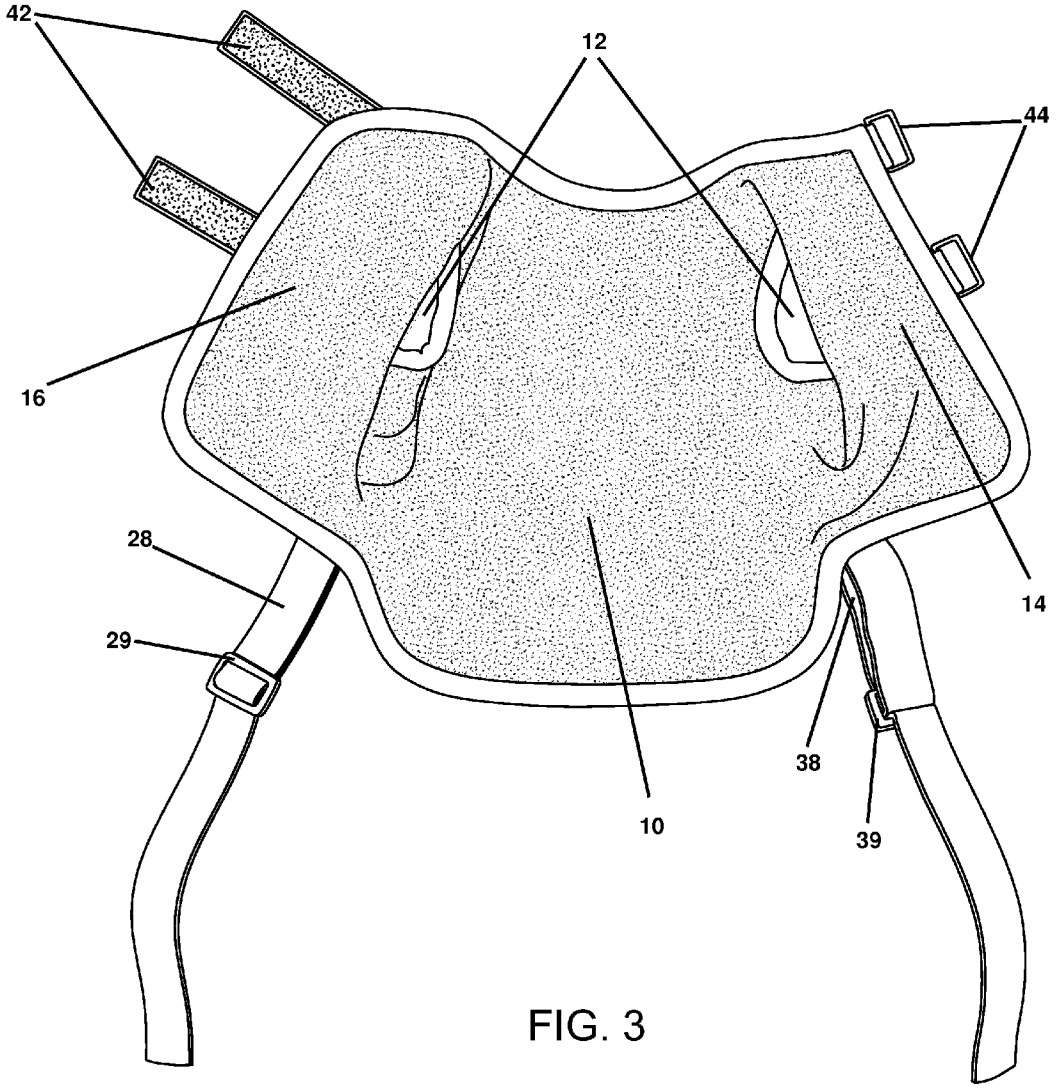
FIG. 3 shows a rear elevation view of the vest depicting the flaps in an open position.

FIG. 3 shows a rear elevation view of the vest 10, with right 14 and left 16 flaps opened. Portions of bands 42, which are self-closing, using a hook and loop or any suitable means of closure known in the art, are depicted on the left flap 16. Said bands 42 are inserted through corresponding rings 44 fixedly attached to the right flap and folded back upon themselves to removably close the vest.

Figure 4:
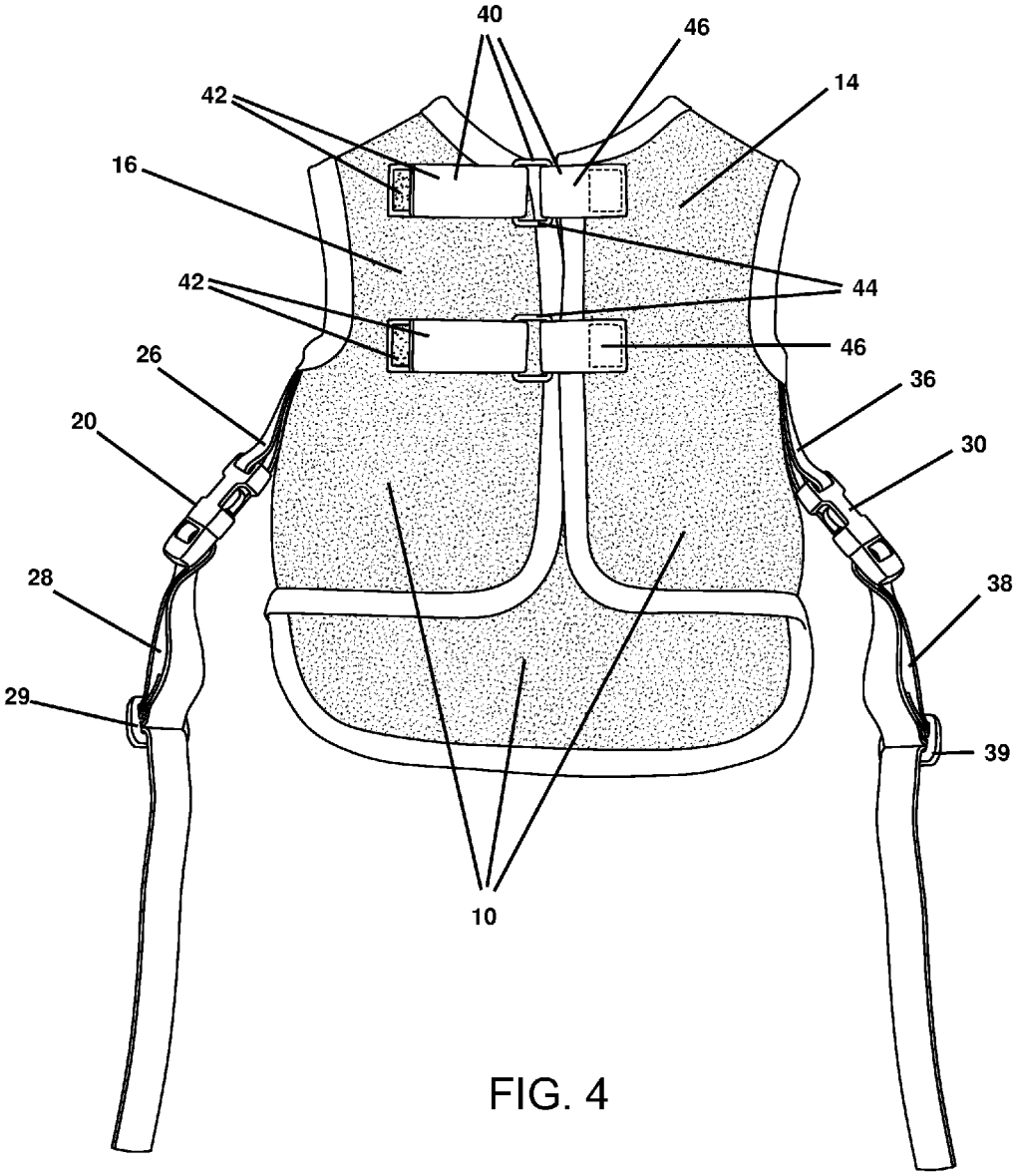
FIG. 4 shows a rear elevation view, with the flaps closed with fasteners and connectors with loops.

FIG. 4 is a rear elevation view of the vest 10 depicting the flaps 14/16 in a closed and fastened state. The vest 10 flaps 14/16 are closed, using two removable fasteners 40. The fasteners may include two bands 42, which are self-closing, using a hook and loop fixedly attached to a flap 16; and corresponding rings 44 fixedly attached to the other flap 14, using any means known in the art, which can be a loop 46. The flaps 14/16 are closed by threading the bands 42 through their corresponding rings 44, with each band 42 being folded onto itself and being secured through said hook and loop or any suitable means of closure known in the art. "Ring," as used in this application, may include any suitably shaped solid opening of any suitable material known in the art through which a band 42 may be threaded. The ring 44 may be in the shape of a rectangle.

Figure 5:
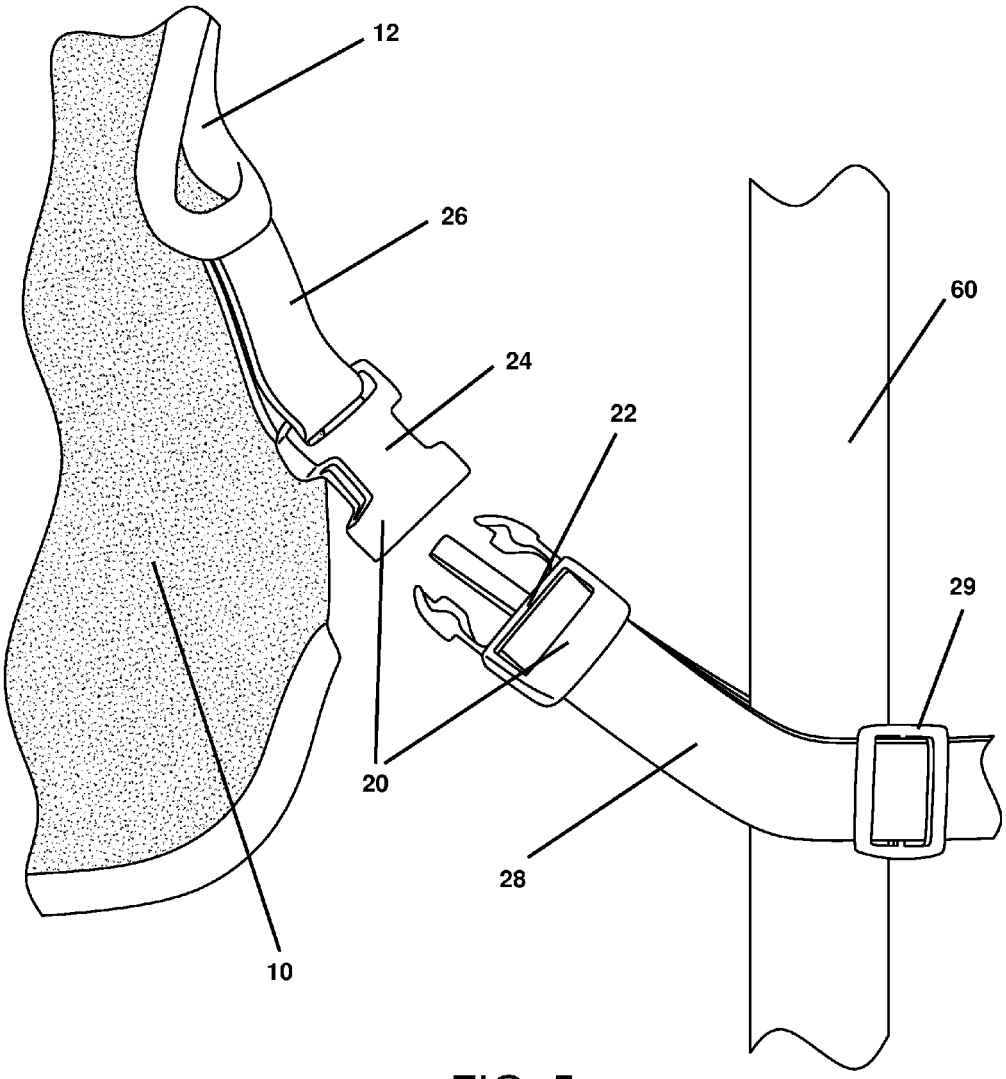
FIG. 5 shows a front elevation view of the two components of a connector in an unattached position, the loop to which each component is attached, and the loop attached to a pole on the back of the chair.

FIG. 5 shows the right first 22 and second 24 portion of the connector 20 in a detached state; the loop 26 attached to the second portion 24 of the connector and vest 10; the first portion 22 of the connector 20 attached to the right loop 28, wherein said right loop encloses the corresponding right bar 60 of the back of a chair and the removably attachable buckle 29, which forms said right loop 28. The components on the left side of the disclosed technology function in the same manner as the aforesaid components on the right side of said technology.

Figure 6:
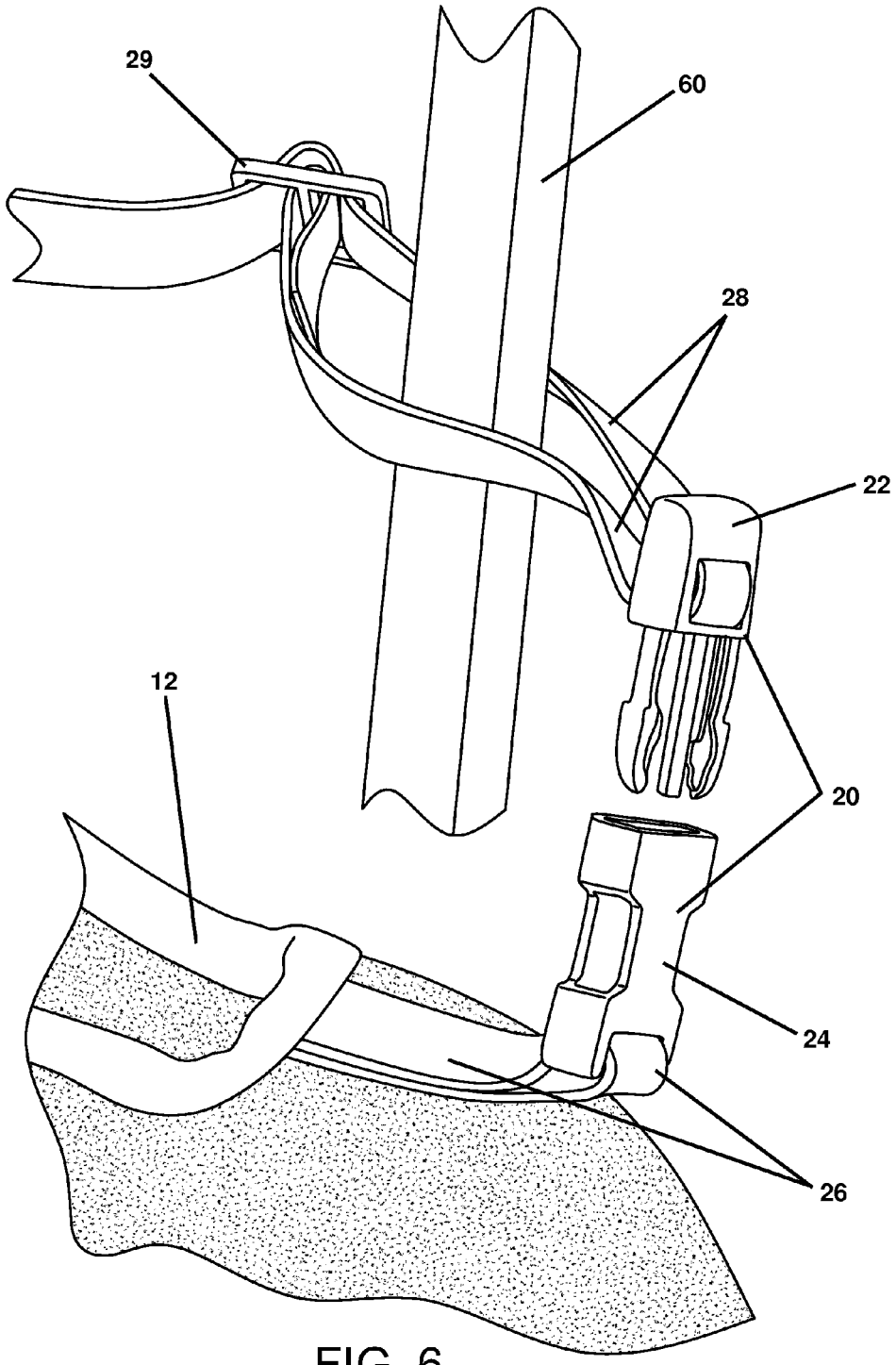
FIG. 6 shows the side elevation view of two unattached components of a connector and the loop to which each component is attached, with a buckle on the loop that attaches to the chair.

FIG. 6 shows a side perspective view of the right first 22 and second 24 portion of the connector 20 in a detached state; the loop 26 attached to the second portion 24 of the connector and vest 10; the first portion 22 of the connector 20 attached to the right loop 28, wherein said right loop encloses the corresponding right bar 60 of the back of a chair and the removably attachable buckle 29 which forms said right loop 28. The components on the left side of the disclosed technology function in the same manner as the aforesaid components on the right side of said technology.

Figure 7:
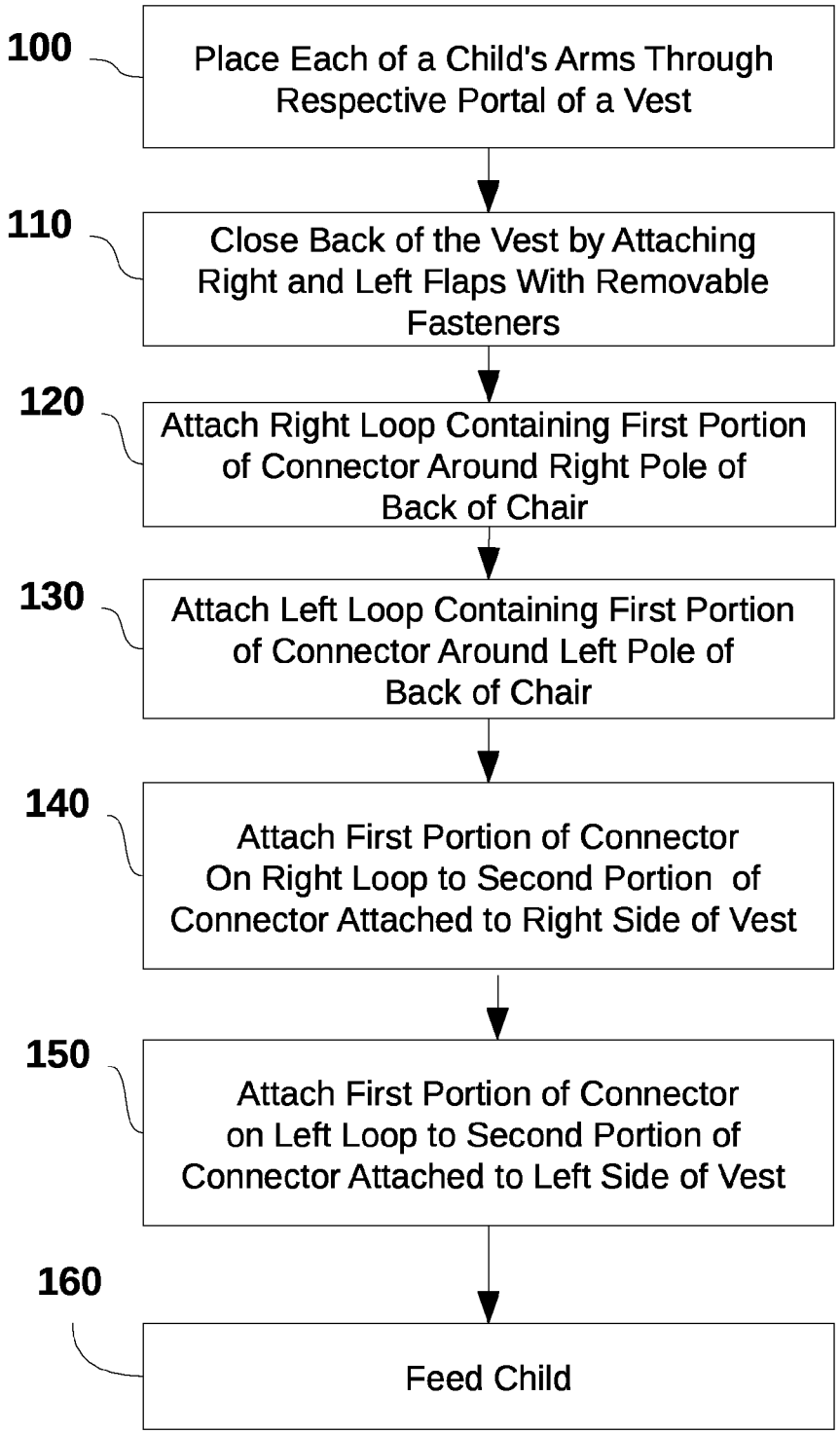
FIG. 7 shows the steps for carrying out the disclosed method.

FIG. 7 shows the steps for carrying out the disclosed method. The first step 100 involves placing a child's arms through a respective portal of a vest. Next, the back of the vest is closed by attaching the left and right flaps of the vest, using removable fasteners 110. Right and left loops, each including a first portion of a connector, are attached to respective right and left poles of the back of a chair 120/130. The first portions of the right and left loops are then attached to the second portions of the corresponding connectors attached to the right and left side of the vest 140/150. The child then can be fed or otherwise interacted with 160.

It should be understood that while the technology has been described with reference to the type of chair shown in the figures, it is within the scope of this disclosure to use any chair with spaced apart bars, poles, slats or the like. Such a chair can be a plastic molded chair, for example. A strap can be threaded through the slits from back to front and a buckle applied. Further, the straps disclosed can be permanently attached to the chair or extend there-from, using any of the types of chairs described. Further, instead of a vest, one can use a harnass strap to harnass a person to the chair by way of the connectors on or connected to the chair.

While the invention has been taught with specific reference to the above embodiments, a person having ordinary skill in the art will recognize that changes can be made in form and detail without departing from the spirit and the scope of the invention. The described embodiments are to be considered in all respects only as illustrative and not restrictive. All changes that come within the meaning and range of equivalency of the claims are to be embraced within their scope.

The invention claimed is:

1. A method of securing a child in a chair comprising the steps of:

placing each arm of a child's left and right arms through a respective portal of a vest and simultaneously covering a torso of said child with a torso area of said vest;

closing a back of said vest by attaching left and right flaps together with removable fasteners, wherein each of said left and right flaps forms a contiguous structure with each other of said left and right flaps by way of said torso area of said vest;

attaching each of a first set of right and left loops, each extending directly from a respective one of said portals, to a respective right and left pole of a chair via:

a second set of respective right and left loop around said respective right and left pole of said chair, and a respective left and right removable connector, wherein said right and left poles are on either side of a back of a chair; and attaching first and second portions of each of said left and a right removable connector together, wherein:

said first portions of each said left and right removable connector form a unitary structure with a corresponding one of said first set of said left and right loops; and said second portions of each said left and right removable connector are permanently attached to corresponding left and right sides of said vest.

2. The method of claim 1, wherein each of said first set of said left and right loops is disconnectable from itself to form a length of fabric.

3. A device for securing a child in a chair, comprising:

a vest suitable for covering the front, back and sides of a child's torso, said vest comprising a torso and having an opening extending from a collar of said vest to a bottom of said vest and forming left and right flaps, said vest further comprising an arm portal at each of left and right sides of said vest;

a first set of fastening mechanisms having a fixed portion attached to each of said left and said right flaps which removably fasten together said left and right flaps;

a second set of fastening mechanisms having a fixed portion, relative to said vest, attached to said torso of said vest via a loop, each said loop attached between one of said arm portals and said bottom of said vest; and a left and right strap, each with a removable fastening mechanism at a first end and a loop at a second end, wherein each said removable fastening mechanism of said left and right strap removably attaches to a corresponding right and left of said second set of fastening mechanisms, wherein each fastening mechanism of said second set of fastening mechanisms is attached to said loop which is, in turn, directly attached to one of said arm portals located at a corresponding one of said right and left sides of said vest, and wherein said second set of fastening mechanisms is permanently attached to a respective said loop, different from said loop at said second end of said left and right straps, said loops attached to said second set of fastening mechanisms being permanently attached to said vest.

4. The device of claim 3, wherein said opening is located on the back of said vest.

5. The device of claim 3, wherein each of said first set of fastening mechanisms comprises:

a strap bearing a hook and loop removable attachment mechanism on one side of the strap and defining a first end of said strap which is fixedly attached to one of said left and right flaps and a second unattached end; and a ring fixedly attached to the other of said left and right flaps, wherein when said fastening mechanism is fastened said second unattached end of said strap is inserted through said ring, such that a first portion of said strap is folded onto a second portion of said strap and is attached thereto using said hook and loop removable attachment mechanism.

6. The device of claim 5, wherein said ring of each of said first set of fastening mechanisms is contained in a loop which loop is fixedly attached to said other of said left and right flaps near an edge of the flap.

7. A device for securing a child in a chair, comprising:

a vest with at least a portal for the head, a portal for each arm, and a portal for the torso;

at least two straps fixed to each of a left and right side of said vest and directly connected to a bottom side of one of said arm portals, each having a first part of a removable connector fixedly attached to a respective said one of said arm portals via a respective said strap of said at least two straps;

at least one length of fabric with a loop and a second part of said removable connector, wherein said first part of said removable connector and said second part of said removable connector are adapted to removably attach to each other, or are removably attached to each other.

8. The device of claim 7, wherein said at least one length of fabric comprises two lengths of fabric, a first of said two lengths of fabric attaching to a first of said at least two straps on said left side of said vest and a second of said two lengths of fabric attaching to a second of said at least two straps on said right side of said vest.

9. The device of claim 7, wherein each said loop of said at least one length of fabric is attached around a pole of a chair.

* * * * *